US008763357B1

(12) United States Patent
Arnone

(10) Patent No.: US 8,763,357 B1
(45) Date of Patent: Jul. 1, 2014

(54) INTERCHANGEABLE JEWELRY METHOD USING INDIVIDUAL BEADED LINKS

(71) Applicant: Cheska Arnone, Clearwater, FL (US)

(72) Inventor: Cheska Arnone, Clearwater, FL (US)

( * ) Notice: Subject to any disclaimer, the term of this patent is extended or adjusted under 35 U.S.C. 154(b) by 0 days.

(21) Appl. No.: 13/932,648

(22) Filed: Jul. 1, 2013

(51) Int. Cl.
*A44C 25/00* (2006.01)
*A44C 15/00* (2006.01)

(52) U.S. Cl.
USPC ..... 59/35.1; 59/80; 59/82; 59/83; 59/84; 59/85; 59/92; 59/93

(58) Field of Classification Search
USPC ..... 59/78, 80, 82, 83, 84, 85, 92, 93
See application file for complete search history.

(56) References Cited

U.S. PATENT DOCUMENTS 232,814 A * 10/1880 Granbery ..... 59/82
1,510,421 A * 9/1924 Sherman ..... 63/3.1
1,622,770 A * 3/1927 Coombs ..... 63/4
D158,320 S * 4/1950 Philippe ..... D11/8
3,386,240 A * 6/1968 Blumstein ..... 59/78
3,733,852 A * 5/1973 Johnson et al. ..... 63/37
D265,807 S * 8/1982 Barr ..... D11/8
4,879,882 A * 11/1989 Johnson et al. ..... 63/4
5,794,459 A * 8/1998 Ignatowski ..... 63/38
6,098,202 A * 8/2000 Peck ..... 2/244
6,681,598 B2 * 1/2004 Cheng ..... 63/3.1
7,322,214 B2 * 1/2008 Ignatowski ..... 63/38
D635,608 S * 4/2011 Gray et al. ..... D16/341
7,980,095 B1 * 7/2011 Masterson ..... 63/41

* cited by examiner

*Primary Examiner* — David B Jones

(57) ABSTRACT

An interchangeable and customizable jewelry and accessory system using individual beaded links 1 to allow the user to create jewelry, fashion & home accessories quickly and easily without prior jewelry making experience. Each design can easily be changed to create a new design without affecting the quality and structure of the main components. Using this method, individual beaded links 1 can be detached and re-attached at any point within the design to create an entirely different design at any time. Individual beaded links 1 and connector links 3 as well as any clasp, finding or embellishment 2 can be used and re-used over and over without damaging any component of the design providing for a truly interchangeable jewelry and accessory system.

6 Claims, 4 Drawing Sheets

INTERCHANGEABLE JEWELRY METHOD USING INDIVIDUAL BEADED LINKS

This application claims the benefit of provisional patent application Ser. No. 61/669,641 filed 2012 Jul. 9 by the present inventor.

BACKGROUND OF INVENTION AND PRIOR ART

The following is a tabulation of some prior art that presently appears relevant:

| U.S. Patents | | | |
|---|---|---|---|
| Pat. No. | Kind Code | Issue Date | Patentee |
| U.S. Pat. No. 6,594,871 | B2 | 2013-02-19 | Huynh |
| U.S. Pat. No. 6,715,315 | B1 | 2004-04-06 | Hartgrove |
| Pat. No. 20040011079 | A1 | 2004-01-22 | Rose |

Beaded chains have been created for centuries. Previously to create a beaded chain, one would need to study and practice the process of cutting wire, inserting it through a bead, bending the wire over and looping it with a combination of jewelry tools. This is a long and tedious process that requires skill, patience, time, and experience to master. There is a need by humans to create, especially in the area of jewelry. Many people do not feel they are talented or crafty enough to make their own jewelry. Our method allows anyone to become a jewelry designer. Most people with a desire to create their own jewelry have good intentions. They may spend the necessary time and money to gather all of the required tools and supplies to become a jewelry maker. However, many will find it frustrating to master the technique of making beaded chains. Many will give up before their intended design is ever created hence ending up with a stockpile of jewelry supplies that will never be used.

Our method eliminates the most difficult part of creating beaded chains by using pre-made individual beaded links. Individual pre-made beaded links are linked together one by one using individual pre-made connector links and a pair of common jewelry tools such as chain or round nose pliers or even by hand without tools. Connector links are split apart and slid through loops from adjacent beaded links and then reclosed thus connecting beaded links. This process is repeated over and over by the user throughout the length of the design. Our method allows anyone to design and create their own jewelry without any prior jewelry making experience and in a fraction of the time. Furthermore, since the beaded and connector links are pre-made, quality and uniformity of the end piece is assured. Our method makes it possible for anyone of almost any age to create costume or high end jewelry and accessories and also claim the honorable status of the designer.

Prior art jewelry methods have been provided offering a degree of interchangeability with respect to characteristics such as settings. In this case, the overall character and appearance of the particular piece nonetheless remains the same. Furthermore, these prior art jewelry methods do not provide the adaptability to function as items which can be worn as different types of jewelry and accessories. Current jewelry also fails to combine with other types of jewelry items to provide a wide array of differing styles and appearances. As a result, a need exists to provide a jewelry system that fulfills these needs and overcomes the disadvantages of traditional and prior art jewelry methods.

Therefore, a principal object of the present embodiment is to provide a jewelry system that is interchangeable and customizable.

Another object of the present embodiment is to provide a jewelry method adaptable to function as household and fashion accessories as well as jewelry.

Yet another object of the present embodiment is to provide a jewelry system that includes accessories which are interchangeably connectable to present a plurality of configurations and ensembles.

These and other objects, features, or advantages of the present embodiment will become apparent from the specification and claims.

In one example, U.S. Pat. No. 6,594,871 provides for interchangeable ornamentation in articles of jewelry using magnets fixed to both a decorative element and to a frame designed to receive the decorative element. To remove the decorative element a stylus is needed to remove the decorative element from the frame.

In another example, U.S. Pat. No. 6,715,315 provides for interchangeable jewelry settings using two mounting portions magnetically coupled together between which is held an interchangeable setting. To remove the interchangeable setting, the mounting portions are designed with an axis of rotation so that at least one of the mounting portions can be rotated. This causes the two mounting portion surfaces to slide and break the magnetic coupling between the two mounting portions. While these approaches provide for interchangeability in jewelry ornamentation and decorative elements, there is still much room for improvement in interchangeable jewelry and accessories. For example, these approaches require multiple parts in order to secure the interchangeable decorative element not easily mastered by one with little or no experience. In addition, the interchangeable decorative elements are normally made from expensive materials such a precious stone or metals which many people may not be able to afford. Our method makes it affordable for anyone to create their own jewelry and accessories quickly and with no experience. Furthermore, our method uses the widest range of materials from very inexpensive to more costly elements allowing anyone regardless of income level to design and create jewelry and accessories.

In a third example, U.S. Pat. No. 20,040,011,079, provides for a jewelry system in which each segment is connected by magnetic parts. Although interchangeable, it lacks the customization of a broad use of materials available to jewelry designers today. In addition, it does not allow for a beaded chain design which is highly desirable in the current fashion market.

Lacking in prior art is a jewelry concept that allows the jewelry user to mix and match beaded segments of jewelry into any number of custom assemblies. Prior art focuses on the exchange of gemstones within a mounting, or the addition of an extra charm like ornament. Thus the need still exists for a system of interchangeable jewelry which the jewelry wearer will find easy to use, be able to afford and have freedom to choose from hundreds of different types of elements. This embodiment addresses all of those needs. There is no prior art allowing the quick and interchangeable assembly of beaded chains.

BRIEF DESCRIPTION OF THE DRAWINGS

Drawings-Figures

In the drawings, closely related figures have the same number but different alphabetic suffixes.

DETAILED DESCRIPTION OF THE EMBODIMENT

Figure 1:
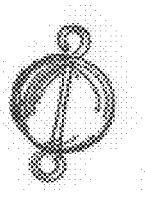
FIG. 1 shows an individual beaded link which is the basis of our method. The beaded link is formed by threading a material such as metal wire through a hole within a bead object. Loops are then formed on each end of the bead.
Figure 1A:
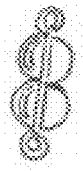
FIG. 1A shows a beaded link created using 2 bead objects since any number of beads can be used to create a beaded link.
Figure 1B:
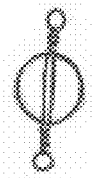
FIG. 1B shows a beaded link where wire is looped and wrapped. Wrapped wire individual beaded and embellish links could be used in the same way to create jewelry and accessories using this method.
Figure 2:
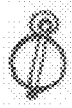
FIG. 2 shows a beaded link with one loop, also called an embellish link. An embellish link is a bead or beads with most likely only one loop which can be added to any jewelry or accessory design to further enhance it. 2A shows an embellish link containing 2 beads since embellish links can be made with any number of beads or objects.
Figure 2A:
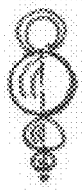
FIG. 2B shows a series of embellish links threaded onto one connector link in order to form a cluster of jewels.
Figure 2B:
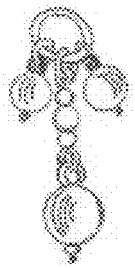
Figure 3:
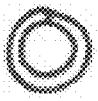
FIG. 3 shows a closed connector link with a split. Connector links are made of material such as metal and are opened and reclosed over adjacent beaded link loops using simple jewelry tools or even by hand.
Figure 3A:
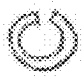
FIG. 3A shows an opened connector link.
Figure 3B:
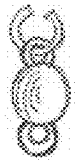
FIG. 3B shows a beaded link threaded onto an opened connector link.
Figure 3C:
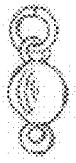
FIG. 3C shows a beaded link threaded onto a connector link which is then closed.
Figure 3D:
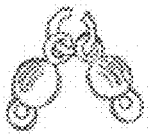
FIG. 3D shows two beaded links threaded onto an opened connector link.
Figure 3E:
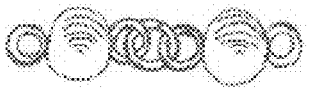
FIG. 3E shows two beaded links threaded onto 1 connector link which is then closed.
Figure 4:
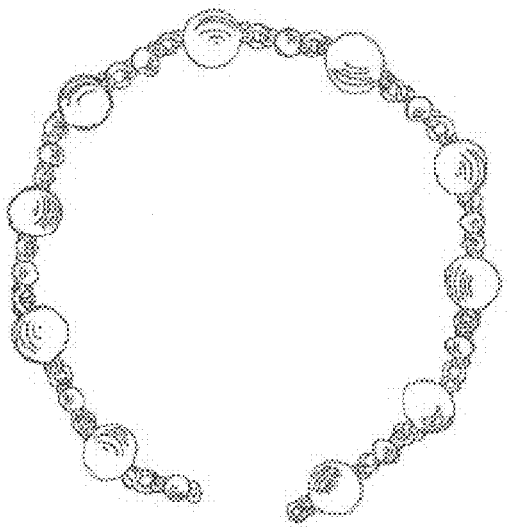
FIG. 4 shows a series of beaded links connected by way of connector links to create a beaded chain.
Figure 5:
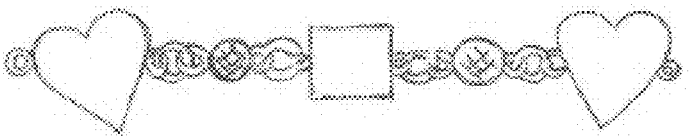
FIG. 5 shows individual beaded links connected to and separated by decorative media and connector links.
Figure 6:
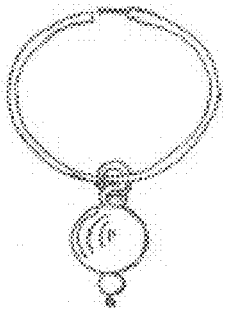
FIG. 6 shows an embellish link attached to a hoop earring.
Figure 6A:
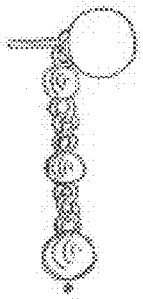
FIG. 6A shows an embellish link attached to a post earring.
Figure 7:
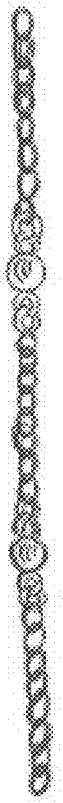
FIG. 7 shows individual beaded links attached to and separated by chain link.
Figure 8:
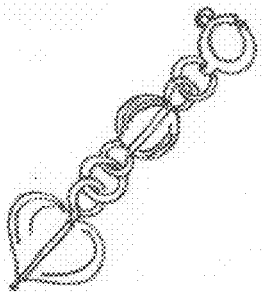
FIG. 8 shows a jewelry and accessory piece created using the method finished with a clasp.
Figure 9:
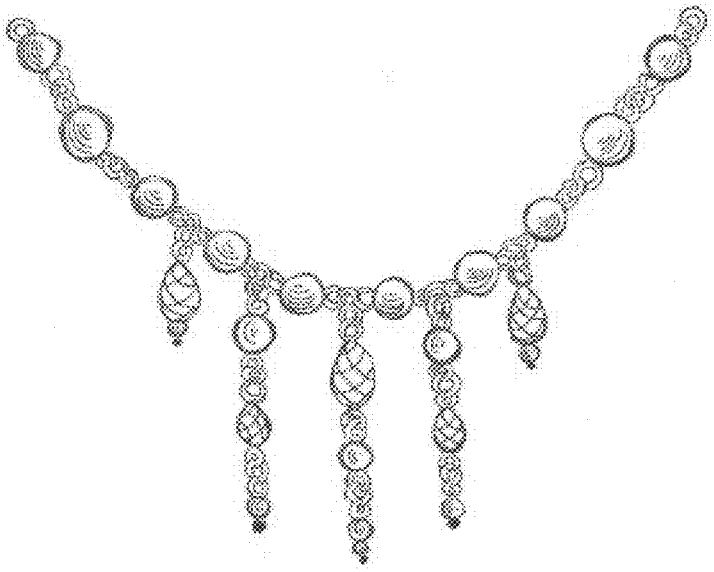
FIG. 9 shows a jewelry example where a plurality of beaded chain segments using the method are then attached to one main beaded chain segment.
Figure 10:
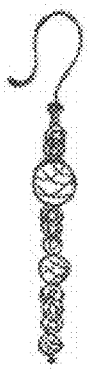
FIG. 10 shows an earring example created using the method.

Referring to the Figures, an interchangeable and customizable jewelry system includes individual beaded links 1 which are interchangeably connectable to present a plurality of configurations and ensembles. The system includes at least one primary beaded link 1. The primary beaded link 1 is a bead or beads made of metal or non metal, glass, plastic, precious or semi precious material through which a metal or non metal material passes through and is looped over to form a hook on one or both ends of the bead. The loops can be of any size and any shape. The material going through or around the bead object could wrap around the material itself or the bead object to create a more elaborate beaded link 1B. The material that passes through the primary beaded link 1 is composed, in whole or in part of decorative metal. The decorative metal can be composed of either precious metal, such as platinum, gold, silver, or the like or alternatively of non-precious decorative metal such as stainless steel, copper, coated copper, or aluminum. However, the material that passes through the primary bead can be composed in whole or in part of materials such as fabric, leather, plastic, or the like without departing from the scope of the invention.

The bead in the primary beaded link 1 is a material made in whole or in part of metal, glass, plastic, stone, precious gem, semi-precious gem, clay, fabric, paper, or leather and most likely will contain a hole for which the metal or non-metal material will pass through and be formed into one or more hooks. It should be noted that a hole is not necessary if the bead object is wrapped with metal wire or other material. Hooks or loops could then be attached to the wire or other material to permit the linking process of the method. More than one bead object can be used to create a beaded link 1A.

The connector link 3 is used to join beaded links 1 together. Connector links 3 are composed, in whole or in part of decorative metal. The decorative metal can be composed of either precious metal, such as platinum, gold, silver, or the like or alternatively of non-precious decorative metal such as stainless steel, copper, coated copper, or aluminum. Connector links 3 could also be composed in whole or in part of materials such as fabric, leather, plastic, or the like without departing from the scope of the invention. Connector links 3 can be of any shape and any size and contain a split, series of splits or no split at all.

It should be noted that connector links 3 are not necessary if the user carefully opens a loop of the beaded link slightly either by hand or with a tool and recloses it over an adjacent loop of a beaded link. This, however, could cause damage to the metal or other loop material thus reducing the aesthetic value of the piece. Furthermore, if loops are opened and then not fully re-closed, this could cause a gap causing the piece to fall apart after it is created.

In one embodiment, a series of beaded links 1 form a decorative chain 4 by way of connector links 3. Notwithstanding, in any embodiment, the first segment includes one or more beaded links 1 or connector links 3 between the start point and end point which can be of any length. Additionally, a beaded link 1 or embellish link 2 can also be added at any point within any pre-made jewelry or accessory piece such as a hoop earring 6, post earring 6A, metal chain 7, chandelier, etc. These individual beaded links 1 are attached by opening a connector link 3A, adding the beaded link 3B and reclosing over the desired object 3C. In another embodiment, an earring is created 10 using the method.

A clasp 8 may be pivotally affixed to the first end without the need for a second clasp since the clasp can be attached to individual beaded links 1 or connector links 3 anywhere along the design. This is due to the loop openings and connector link openings throughout the design. A clasp can be used to hold a design together but is not always necessary. The type of clasps which may be used include lobster, toggle, spring, etc. Other types of hooks the beaded link 1 may be attached to include earring wires, hoop earrings, post earrings and the like. Alternatively, any releasable connecting means such as spring loaded or fold-over clasps, spring ring or lobster claw clasps, S-shaped connectors, magnets, or threaded connectors can be used in place of the hooks without departing from the scope of the present invention.

In the embodiment, the first beaded link 1 will be connected to a second beaded link 1 by way of a connector link 3. This will begin a chain 4 through the repetition of the method.

The system may also include at least one embellish link 2. The embellish link 2 is a bead or multiple beads 2A made of material in whole or in part of metal, glass, crystal, plastic, stone, precious gem, semi-precious gem, clay, fabric, paper, or leather and most likely will contain a hole for which the metal or non-metal material will pass through and be formed into one or more loops to be connected to the main design by way of connector links 3. Additionally, multiple embellish links 2 can be attached with one connector link 3 to an embodiment to form a cluster of beads 2B or swag. Embellish links 2 may be attached to connector links 3 or to the loops of the individual beaded links 1. Embellish links 2 may contain as little as one bead or multiple beads 2A of different shapes and materials.

In one embodiment, the accessory strand 7 is composed of beaded links and segments of a decorative chain. In another embodiment 9, the individual beaded links 1 are formed as a series of asymmetric, fanciful decorative chain segments. Strands of beaded links or embellish links can be attached to multiple locations of a single chain to create an elaborate design. In yet another embodiment, the accessory strand 5 includes a series of beaded links 1 wherein adjacent beaded links 1 are attached to and separated by decorative media such as jewels, jewel settings, charms, chain link, multiple connector links, leather or other material, or the like.

In the embodiment, a design can easily be shortened simply by opening a connector link 3A, removing the beaded link 1, and reclosing the connector link 3. For example, a necklace could be shortened to create a bracelet, an anklet, or even a pair of earrings. Alternately, a design can be lengthened easily by opening a connector link 3A attached to the design, adding a beaded link 3B and reclosing the connector link 3C. This process is repeated as many times as necessary to achieve the ultimate length of the design desired by the user. Furthermore, beaded links can be subtracted from a design and re-used in new designs without damaging the beaded link 1.

Advantages

From the description above, a number of advantages of some embodiments of my interchangeable jewelry and accessory system will become evident:

(a) Beaded chains will be created with ease by anyone of ordinary skill using individual pre-made beaded links joined together by connector links.

(b) Loops on individual beaded links will be connected to one another to form any design or pattern using simple adjustment tools such as but not limited to pliers by way of connector links.

(c) Connector links will be opened and reclosed over adjacent loops of individual beaded links to create any length and form any design.

(d) Connector links are opened and reclosed using a pair of simple jewelry tools such as chain or round nose pliers or the like. Other tools could be used to perform the task. Connector links could be opened and closed by hand without the use of tools.

(e) Beaded chains will be finished to the specifications of each individual by the individual by way of adding a clasp, earring wire, hook, or the like.

(f) Beaded chains created using this method can be further enhanced using connector links to add pendants, charms, embellish links, chain link, etc. anywhere within the design.

(g) Embellish links are easily attached and detached using this method. Embellish links could also be slid over a hoop or post earring to enhance the earring.

(h) Possible uses for this method include but are not limited to the creation of necklaces, bracelets, rings, anklets, earrings, belly chains, belts, barefoot sandals, underwear and bathing suit attachments and straps, purse straps, eyeglass chains, cocktail charms, chandelier and lighting chains, pet collars and accessories, key chains, blouse and dress straps, holiday ornaments and garland, napkin holders, all types of fashion and home accessories.

Although the description above contains many specificities, these should not be construed as limiting the scope of the embodiments but merely as providing illustrations of some of several embodiments. For example, the individual beaded links can be made of any material, be of any shape and any size. The connector links can be made of any material, be of any shape and any size. Connector links may have a split or be completely closed. Individual beaded links can be joined to adjacent beaded links by way of connector links or directly by way of the loops of the connector links. Tools such as chain or round nose pliers can be used to open and reclose connector links in order to join adjacent beaded links. Tools may not be necessary and connector links could be opened and reclosed by hand in order to join adjacent beaded links. Furthermore, multiple connector links, embellishments, any length of chain link, charms, etc. can be joined together with or without the use of individual beaded links and with or without connector links to form a design.

Therefore, an interchangeable and customizable jewelry and accessory system and method of use has been disclosed thereof. Furthermore the interchangeable and customizable jewelry and accessory system and method of use provides the adaptability to function as items which can be worn as different types of jewelry or created as fashion and household accessories. Finally, the interchangeable and customizable jewelry and accessory system includes accessories which are interchangeably connectable to present a plurality of configurations and ensembles. Thus, at the very least all of the stated objectives have been met.

It will be appreciated by those skilled in the art that other various modifications could be made to the method without departing from the scope of this invention. All such modifications and changes fall within the scope of the claims and are intended to be covered thereby.

What is claimed is:

1. A jewelry and accessory method comprising:

providing a plurality of beads, each bead having a first side with a first loop and a laterally spaced second side with a second loop;

providing a plurality of connector links, each connector link having a torus shaped configuration, a cut formed through each connector link, each cut creating opposed circular faces;

initially bending each connector link whereby the opposed circular faces are separated to form an opening;

positioning the first loop of each bead through the opening of an associated connector link;

positioning a second loop of each bead through the opening of the associated connector link; and re-bending each connector link whereby the opposed circular faces are in facing relationship to close the openings and couple the beads.

2. The method as set forth in claim 1 wherein the beads are fabricated from a material chosen from the class consisting of:

metal, pearl, crystal, glass, shell, wood, plastic, precious and semi-precious gems and stones.

3. The method as set forth in claim 1 wherein the connector links are fabricated from a material chosen from the class consisting of platinum, gold, silver, stainless steel, copper, coated copper, and aluminum.

4. The method as set forth in claim 1 wherein the first loops and second loops are fabricated from a material chosen from the class consisting of platinum, gold, silver, stainless steel, copper, coated copper, and aluminum.

5. The method as set forth in claim 1 and further including an additional component coupled to at least one of the connector links, the additional component chosen from the class of additional components consisting of a clasp, hook, and earring wire.

6. A method of fabricating jewelry and accessories formed of coupled beads, the beads being coupled in a simple, convenient, time-efficient, and economical manner, the method including the steps of:

providing a plurality of beads, each bead having a linear passageway extending there through, each linear passageway having a first side and a second side;

providing a plurality of elongated links, each elongated link having a linear central extent, each central extent having a first end formed in a first loop, each central extent having a second end formed in a second loop;

positioning each central extent through an associated passageway with each first loop adjacent to the first side of an associated passageway and with each second loop adjacent to the second side of the associated passageway;

providing a plurality of connector links, each connector link having a torus shaped configuration, a cut formed through each connector link, each cut creating opposed circular faces;

initially bending each connector link whereby the opposed circular faces are separated to form an opening of a size sufficient to allow the passing of a first loop and a second loop there through;

positioning the first loop of each connector link through the opening of an associated connector link;

positioning the second loop of each connector link through the opening of the associated connector link; and re-bending each connector link whereby the opposed circular faces are in facing relationship to close the opening and couple the plurality of beads and thereby abate the separating of each connector link from an associated first loop and second loop.

* * * * *